United States Patent [19]

Wood

[11] Patent Number: 4,613,311

[45] Date of Patent: Sep. 23, 1986

[54] AUTOMATICALLY DISCONNECTING SAFETY CONNECTOR FOR AQUATIC APPARATUS

[76] Inventor: John A. V. Wood, 306 N. Meridian, Waurika, Okla. 73573

[21] Appl. No.: 698,560

[22] Filed: Feb. 6, 1985

[51] Int. Cl.[4] ..... B63B 35/76

[52] U.S. Cl. ..... 441/130; 441/88; 441/131; 441/66; 441/67; 114/345; 24/573; 24/602

[58] Field of Search ..... 441/129, 130, 131, 132, 441/40, 66, 67, 88, 70; 114/345; 24/573, 588, 589, 602, 643; 244/137 A

[56] References Cited

U.S. PATENT DOCUMENTS

| | | | |
|---|---|---|---|
| 947,446 | 1/1910 | Lenz | 211/23 |
| 1,190,743 | 7/1916 | Fageol | 441/131 |
| 1,743,333 | 1/1930 | Ely | 441/131 |
| 1,749,820 | 3/1930 | Johnson | 441/131 |
| 1,764,852 | 6/1930 | Phillips | 441/131 |
| 1,793,905 | 2/1931 | Chesnut | 441/131 |
| 1,838,086 | 12/1931 | Farnstrom | 441/131 |
| 2,011,209 | 8/1935 | Bertram | 272/1 B |
| 2,051,281 | 8/1936 | Webber | 441/131 |
| 2,207,025 | 7/1940 | Rison | 441/131 |
| 2,581,545 | 1/1952 | Long | 441/131 |
| 3,020,569 | 2/1962 | Morris | 441/131 |
| 3,036,316 | 5/1962 | Schuster | 441/131 |
| 3,952,350 | 4/1976 | Moucka | 441/42 X |
| 4,160,299 | 7/1979 | Hilbern | 441/131 |

OTHER PUBLICATIONS

Two photographs of devices which have been on sale at least one year.

*Primary Examiner*—Sherman D. Basinger
*Assistant Examiner*—Paul E. Salmon
*Attorney, Agent, or Firm*—Laney, Dougherty, Hessin, Claro & Beavers

[57] ABSTRACT

An automatically disconnecting connector apparatus for a floatable device, such as a fisherman's float tube, includes one coupling member having an aperture and another coupling member having another aperture. The other coupling member is bifurcated so that it can receive the first-mentioned coupling member therein. In this relationship, the apertures of the coupling members are aligned for receiving a shaft of a pin member which is retained in the apertures by gravity when the floatable device is in an upright position. The pin member is automatically extracted in response to gravity when the floatable device is overturned, thereby automatically disconnecting the connector apparatus.

15 Claims, 15 Drawing Figures

AUTOMATICALLY DISCONNECTING SAFETY CONNECTOR FOR AQUATIC APPARATUS

BACKGROUND OF THE INVENTION

This invention relates generally to automatically disconnecting safety connectors for aquatic apparatus and, more particularly, but not by way of limitation, to an automatically disconnecting connector for the seat of a fisherman's flotation device.

In fishing, a fisherman sometimes sits in a flotation device which is generally constructed of a pneumatic, toroidally shaped tube having a flexible seat strapped within the central opening of the toroidal tube. To facilitate entry into and exit from the seat, a strap generally extends from the front of the seat for connecting with a strap attached with the tube. The means by which the two straps are connected is of critical importance because the straps must be rapidly disconnected when the tube is overturned to prevent the drowning of the fisherman who has overturned with the tube.

Previous types of such connecting means of which I am aware have required manual action by the fisherman to release the connector and thereby unhook the seat. This requirement for manual action by the fisherman can result in a dangerous, even deadly, situation when the overturned fisherman panics or is otherwise unable to manipulate the connector. Therefore, there is the need for a new and improved connector means for an aquatic apparatus, such as a fisherman's flotation device, which connector means does not require any manipulation by an occupant of the apparatus for the occupant to be released therefrom. Specifically, there is the need for an automatically disconnecting safety connector which can be used in a fisherman's flotation device or the like.

SUMMARY OF THE INVENTION

The present invention overcomes the above-noted and other shortcomings of the prior art by providing a novel and improved automatically disconnecting safety connector for aquatic apparatus. The present invention, in a preferred embodiment, connects the seat of a fisherman's flotation device to the device in a manner so that when the device overturns, the connector automatically uncouples to permit the fisherman to be released from the seat without requiring the fisherman to manipulate the connector.

Broadly, the present invention includes a first coupling member attached to a first part of a floatable device, a second coupling member attached to a second part of the floatable device, and weighted pin means for releasably securing the first and second coupling members. The first and second coupling members each has an aperture defined therein. The pin means includes a main body, having a first mass, and a shaft, extending from the main body and having a second mass. The shaft is received in the apertures of the coupling members when the connector apparatus is engaged. The first and second masses are related so that the pin means is held by gravity in these two apertures when the connector apparatus is coupled and the floatable device is in an upright position and so that the pin means is automatically pulled by gravity to remove the shaft from the apertures when the floatable device is overturned from its upright position.

This connector apparatus is particularly useful with, but is not limited to, a float means for floating on water having a seat means associated therewith. The seat means has a strap extending therefrom for engagement by the connector means of the present invention with a strap extending from the float means. This other strap can be fixed to a cover having the float means disposed therein or it can have a buckle attached thereto for releasably retaining the strap on the float means.

Therefore, from the foregoing, it is a general object of the present invention to provide a novel and improved automatically disconnecting safety connector for aquatic apparatus. Other and further objects, features, and advantages of the present invention will be readily apparent to those skilled in the art when the following description of the preferred embodiments is read in conjunction with the accompanying drawings.

DETAILED DESCRIPTION OF THE PREFERRED EMBODIMENTS

Figure 1:
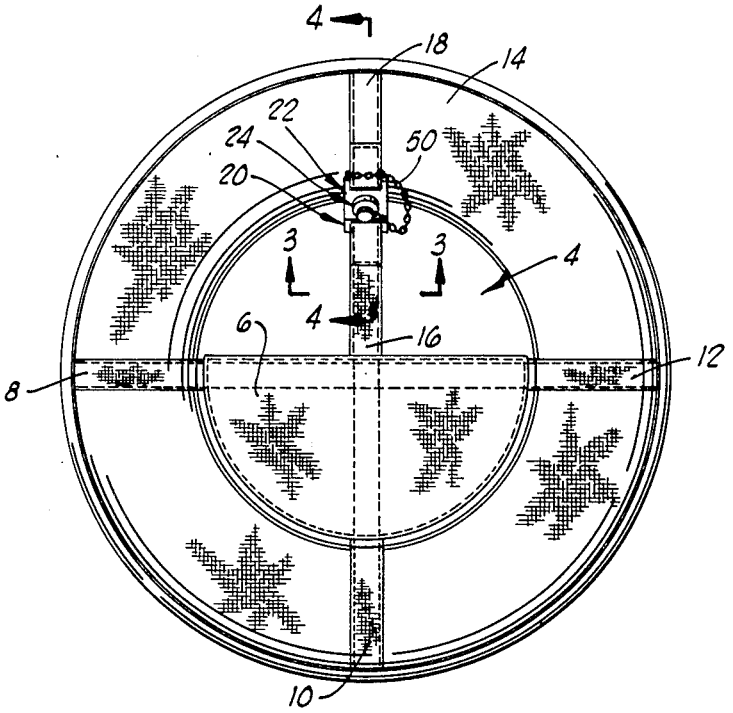
FIG. 1 is a top plan view of a first preferred embodiment of an aquatic apparatus including the automatically disconnecting safety connector of the present invention.
Figure 2:
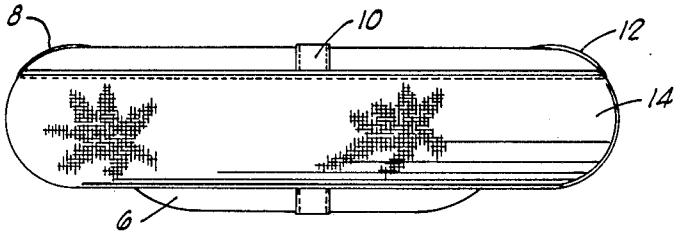
FIG. 2 is a side view of the embodiment shown in FIG. 1.
Figure 3:
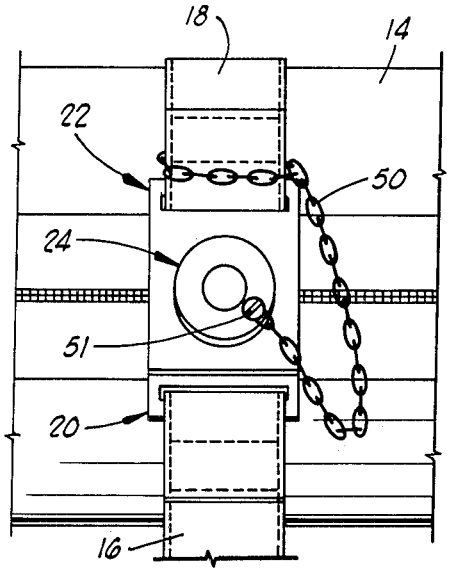
FIG. 3 is an enlarged view, taken along line 3—3, of a portion of the embodiment shown in FIG. 1.
Figure 4:
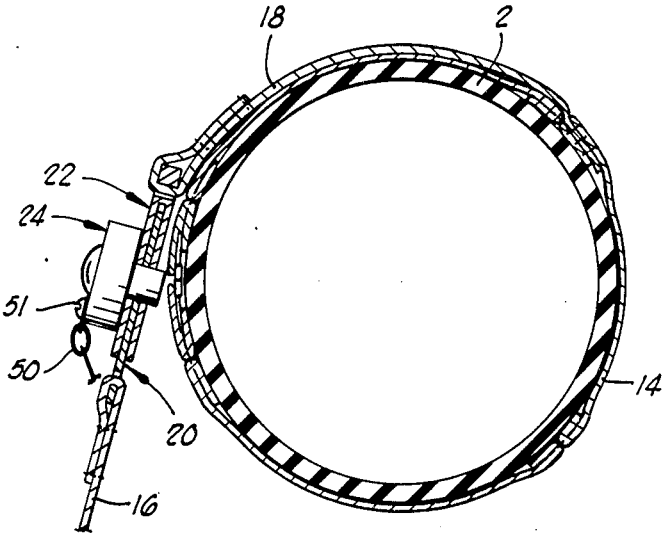
FIG. 4 is a sectional view taken along line 4—4 shown in FIG. 1.
Figure 5:
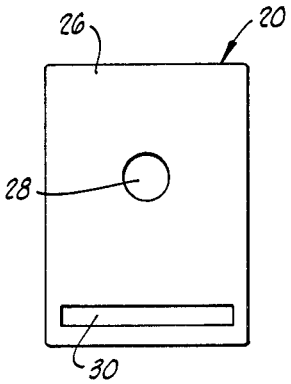
FIG. 5 is a side view of one coupling member of the present invention.
Figure 6:
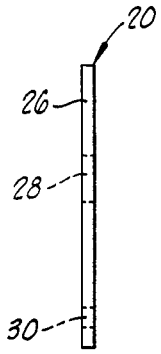
FIG. 6 is an end view of the coupling member shown in FIG. 5.
Figure 7:
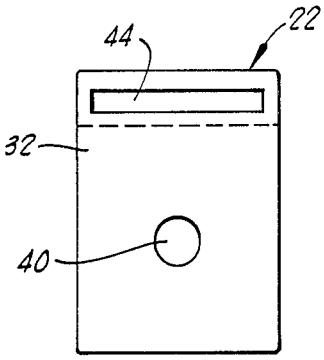
FIG. 7 is a side view of another coupling member of the present invention.
Figure 8:
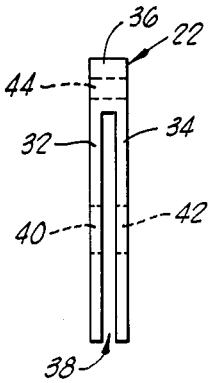
FIG. 8 is an end view of the coupling member shown in FIG. 7.
Figure 9:
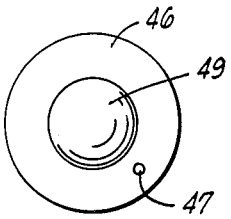
FIG. 9 is a top plan view of the pin means of the present invention.
Figure 10:
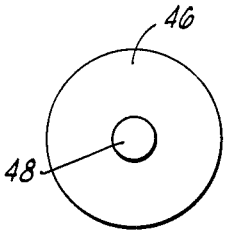
FIG. 10 is a bottom plan view of the pin means of the present invention.
Figure 11:
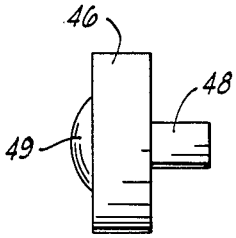
FIG. 11 is a side view of the pin means of the present invention.

Referring initially to FIGS. 1–11, the present invention as used with a first preferred embodiment of a floatable aquatic device will be described. In this embodiment the floatable aquatic device includes a fisherman's float, which floats on water as known to the art, including a pneumatic tube 2 having a toroidal shape in which a central opening 4 is defined. The pneumatic tube 2 is of an ordinary construction for being filled with air or the like to make it buoyant in water as known to the art.

Associated with the tube 2 is a seat means for holding an occupant within the central opening 4 of the tube 2. The seat means of the first embodiment includes a seat section 6 made of a flexible material of a type as known to the art. The section 6 is fastened relative to the tube 2 by three fixed retaining straps 8, 10, 12, each of which has one end sewn to a portion of the seat section 6 and another end sewn to a cover 14 which has the tube 2 retained therein by means of a zipper or other fastener means of a type as known to the art. The straps 8, 10, 12 are spaced around the tube 2 and attached to respective spaced portions of the seat section 6.

The seat means has a fourth strap 16 which extends from the front part of the seat section 6. One end of the strap 16 is sewn or otherwise affixed to the section 6. The other end of the strap 16 is free so that it can receive a part of the connector means of the present invention for connecting to a retaining strap 18 sewn to the cover 14 in spaced relation to the straps 8, 10, 12. By having the strap 16 and the strap 18 releasably connectible by the connector means of the present invention, access to and from the seat is made easier.

The connector means of the present invention is used for connecting the strap 16 to the strap 18 when the float means provided by the tube 2 is in an upright position and for automatically disconnecting, in response to gravity, the strap 16 from the strap 18 when the float means is in an overturned position. The connector means of the present invention includes two coupling members 20, 22 and a weighted pin means 24 for releasably securing the coupling members 20, 22 together.

The coupling member 20 of the preferred embodiment includes a rectangular rigid metallic plate 26 having a circular aperture or hole 28 defined therein in substantially the central portion thereof. The aperture 28 extends through the entire width or thickness of the plate 26. Defined near one end of the rigid plate 26 is a rectangular slot 30 which receives the free end of the strap 16. The free end of the strap 16 is inserted through the slot 30 and doubled back and then sewn to itself as illustrated in the drawings.

The coupling member 22 of the preferred embodiment has a bifurcated body with a rectangular rigid metallic plate member 32 spaced in parallel relationship to a rectangular rigid metallic plate member 34. The plate members 32, 34 are integrally connected at one end by a web portion 36. The spacing of the plate members 32, 34 defines a slot or mouth 38 having a width greater than the width of the plate member 26 so that the plate member 26 can be received therein. The plate member 32 has a circular aperture or hole 40 defined therein and the plate member 34 has a circular aperture or hole 42 defined therein. The apertures 40, 42 extend through the entire widths or thicknesses of the respective plate members, and the apertures 40, 42 are oriented so that they align with each other and with the aperture 28 of the plate member 26 when the plate member 26 is inserted into the mouth 38. A rectangular slot 44 is defined through the web portion 36 for receiving the free end of the strap 18. After the free end of the strap 18 has been threaded through the slot 44, the free end is doubled back upon itself and sewn thereto to secure the coupling member 22.

The coupling members 20, 22 are held together by the weighted pin means 24 which includes in the preferred embodiment a cylindrical main body 46 having a first mass or weight. The main body 46 has an outer diameter which is greater than the diameters of the apertures 40, 42 so that the main body 46 will not pass through these apertures. A hole 47 is defined through the top surface of the main body 46 for a purpose to be subsequently described.

Extending from the main body 46 is a straight shaft portion 48 having a cylindrical shape in the preferred embodiment. The outer diameter of the cylindrical shaft 48 is less than the diameters of the apertures 28, 40, 42 so that the shaft 48 can be received therein. The shaft 48 has a head portion 49. The shaft 48 has a second mass or weight which is related to the mass and weight of the main body 46 so that the pin means 24 is held by gravity in the apertures 28, 40, 42 when the shaft 48 is disposed therein and the tube 2 is in an upright position and so that the pin means 24 is automatically pulled by gravity, thereby removing the shaft 48 from the apertures 28, 40, 42, as soon as the tube 2 is overturned from its upright position. In the preferred embodiment the weight of the shaft 48 is less than the weight of the main body 46.

So that the pin means 24 will not be lost when the tube 2 is overturned, it also includes retainer means for retaining the main body 46 and the shaft 48 to the tube 2 when the shaft 48 is removed from the apertures 24, 40, 42. In the preferred embodiment the retainer means includes a chain 50 having one end connected through the loop defined by the doubled-back strap 18 adjacent the slot 44 and having another end suitably secured to the top of the main body 46, such as by a screw 51 threadedly connected in the hole 47 of the main body 46.

In operation, the connector apparatus is used to retain the coupling members 20, 22 in a connected relationship when the tube 2 is maintained in an upright position, which position is illustrated in FIG. 1. To assume this position, the fisherman enters the central opening 4 of the tube 2 and pulls the strap 16 between his legs. The fisherman inserts the plate member 26 into the mouth 38 of the bifurcated body of the coupling member 22. The apertures 28, 40, 42 are aligned and the shaft 48 of the pin means 24 is inserted into these aligned apertures from above as viewed in FIG. 1. Gravity holds the pin means 24 in this position as long as the tube 2 is maintained in its upright position.

Figure 12:
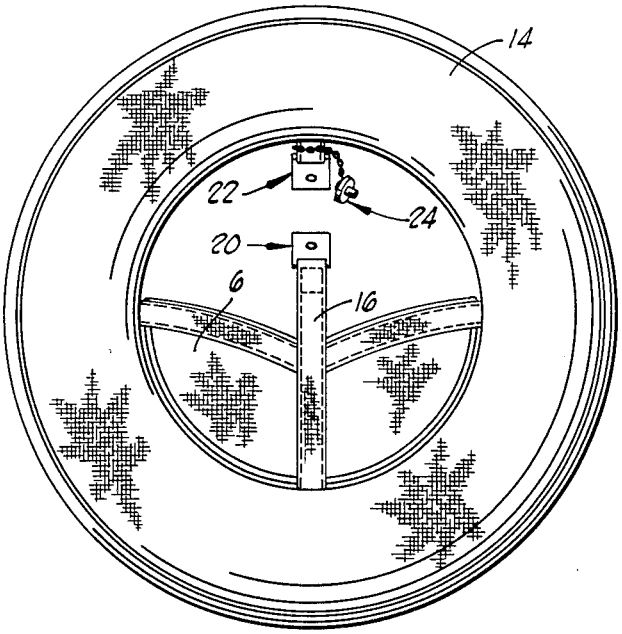
FIG. 12 is a view of the first preferred embodiment shown in an overturned position.

Should the tube 2 become overturned to a position such as is illustrated in FIG. 12, gravity and the masses of the main body 46 and shaft 48 create a force which automatically moves the pin means 24 out of the apertures 28, 40, 42. This extraction is facilitated by the smooth surface and smaller diameter of the cylindrically shaped shaft 48. When the shaft 48 is extracted, the coupling member 20 separates from the coupling member 22 whereby the straps 16, 18 are separated to allow the fisherman to escape the overturned tube 2.

Figure 13:
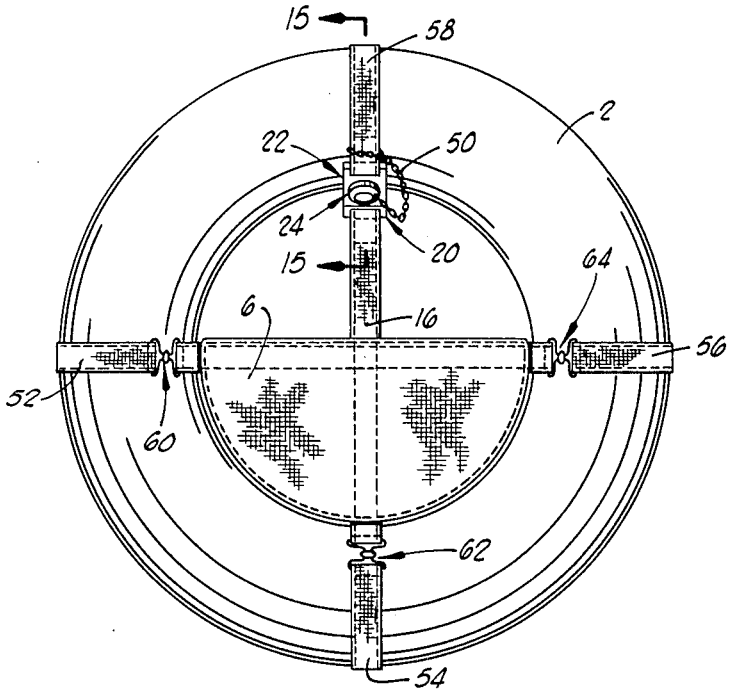
FIG. 13 is a plan view of a second preferred embodiment of an aquatic apparatus including the present invention.
Figure 14:
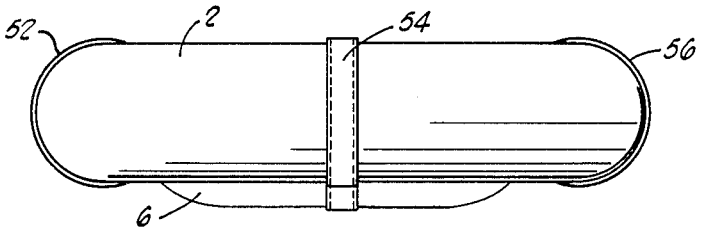
FIG. 14 is a side view of the embodiment shown in FIG. 13.
Figure 15:
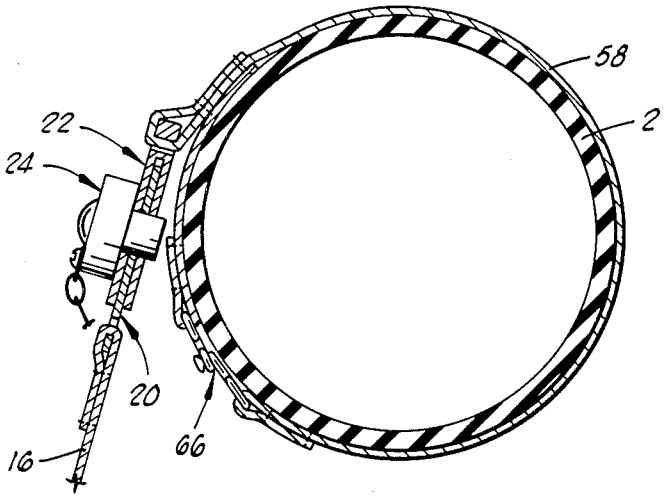
FIG. 15 is a sectional view taken along line 15—15 shown in FIG. 13.

A second embodiment of a floatable device with which the present invention can be used is shown in FIGS. 13–15. This embodiment is substantially the same as the first embodiment as indicated by like reference numerals; however, the second embodiment has retaining straps 52, 54, 56, 58 which are buckled about the tube 2 by buckles 60, 62, 64, 66, respectively, rather than being sewn to a cover as in the first embodiment. The construction of the connector means and its operation with respect to this second embodiment are the same as with respect to the first embodiment.

Thus, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A connector apparatus for a floatable device, which connector apparatus automatically disconnects when the floatable device is overturned, said connector apparatus comprising:

a first coupling member having a first aperture defined therethrough, said first coupling member including means for receiving a first part of the floatable device;

a second coupling member having a second aperture defined therein, said second coupling member including means for receiving a second part of the floatable device; and weighted pin means for being inserted into said first and second apertures to releasably secure said first coupling member to said second coupling member when said first and second coupling members are disposed adjacent each other and said first and second apertures are aligned and for being moved out of said first and second apertures in response to gravity to release said first and second coupling members when the floatable device is overturned.

2. A connector apparatus for a floatable device, which connector apparatus automatically disconnects when the floatable device is overturned, said connector apparatus comprising:

a first coupling member attached to a first part of the floatable device, said first coupling member having a first aperture defined therethrough;

a second coupling member attached to a second part of the floatable device, said second coupling member having a second aperture defined therein; and weighted pin means for releasably securing said first coupling member to said second coupling member when said first and second coupling members are disposed adjacent each other and said first and second apertures are aligned, said weighted pin means including:

a main body having an outer dimension greater than said second aperture and having a first weight;

a straight shaft extending from said main body for disposition in said first and second apertures when said first and second coupling members are releasably secured by said weighted pin means, said shaft having a second weight less than said first weight; and retainer means for retaining said main body and said shaft to the floatable device when said shaft is removed from said first and second apertures.

3. The connector apparatus of claim 1, wherein:

said first coupling member includes a first rigid plate member having said first aperture defined therethrough; and said second coupling member includes a bifurcated body having a second rigid plate member and a third rigid plate member spaced from said second rigid plate member so that a slot for receiving said first rigid plate member is defined between said second and third rigid plate members, said second and third rigid plate members having said second aperture defined therethrough for receiving said weighted pin means to releasably secure said first rigid plate member between said second and third rigid plate members when said first and second apertures are aligned.

4. A connector apparatus for a floatable device, which connector apparatus automatically disconnects when the floatable device is overturned, said connector apparatus comprising:

a first coupling member attached to a first part of the floatable device, said first coupling member including a first rigid plate member having a first aperture defined therethrough;

a second coupling member attached to a second part of the floatable device, said second coupling member having a second aperture defined therein, said second coupling member also including a bifurcated body having a second rigid plate member and a third rigid plate member spaced from said second rigid plate member so that a slot for receiving said first rigid plate member is defined between said second and third rigid plate members; and weighted pin means for releasably securing said first coupling member to said second coupling member when said first and second coupling members are disposed adjacent each other and said first and second apertures are aligned, said weighted pin means including:

a main body having an outer dimension greater than said second aperture and having a first weight;

a straight shaft extending from said main body for disposition in said first and second apertures when said first and second coupling members are releasably secured by said weighted pin means, said shaft having a second weight less than said first weight; and retainer means for retaining said main body and said shaft to the floatable device when said shaft is removed from said first and second apertures.

5. An automatically disconnecting aquatic connector apparatus for releasably connecting a first strap of a seat to a second strap of a tube of a fisherman's flotation device, said connector apparatus comprising:

first plate means connected to the first strap, said first plate means having a first hole defined therethrough;

second plate means connected to the second strap, said second plate means having a second hole defined therethrough; and pin means, receivable in said first and second holes, for holding said first and second plate means together when the tube is in an upright position, said pin means including:

a main body having a first mass; and a shaft, extending from said main body, having a second mass, said first and second masses related so that said pin means is held by gravity in said first and second holes when said shaft is disposed therein and the tube is in said upright position and so that said pin means is automatically pulled by gravity, thereby removing said shaft from said first and second holes, as soon as the tube is overturned from said upright position.

6. The connector apparatus of claim 5, wherein said second plate means is bifurcated so that a slot is defined therein for receiving said first plate means.

7. The connector apparatus of claim 6, wherein said pin means includes retainer means for securing said main body to the tube.

8. A safety-connected aquatic apparatus, comprising:

float means for floating on water;

seat means for holding an occupant received in said float means, said seat means having a strap extending therefrom so that said seat means can be at least partially disconnected from said float means; and connector means for connecting said strap to said float means when said float means is in an upright position and for automatically disconnecting, in response to gravity, said strap from said float means when said float means is in an overturned position.

9. The safety-connected aquatic apparatus of claim 8, wherein said connector means includes:

a first coupling member attached to said strap, said first coupling member having a first aperture defined therein;

a second coupling member attached to said float means, said second coupling member having a second aperture defined therein; and weighted pin means for releasably securing said first coupling member to said second coupling member when said first and second apertures are aligned.

10. The safety-connected aquatic apparatus of claim 9, wherein:

said first coupling member includes a first rigid plate member having said first aperture defined therethrough; and said second coupling member includes a bifurcated body having a second rigid plate member and a third rigid plate member spaced from said second rigid plate member so that a slot for receiving said first rigid plate member is defined between said second and third rigid plate members.

11. The safety-connected aquatic apparatus of claim 9, wherein said connector means further includes a second strap connected to said float means, said second strap having said second coupling member connected thereto.

12. The safety-connected aquatic apparatus of claim 11, wherein said second strap is fixed to a cover having said float means disposed therein.

13. The safety-connected aquatic apparatus of claim 11, wherein said second strap has a buckle attached thereto for releasably retaining said second strap on said float means.

14. The safety-connected aquatic apparatus of claim 11, wherein said connector means still further includes retainer means for connecting said weighted pin means to said second strap.

15. The safety-connected aquatic apparatus of claim 9, wherein said weighted pin means includes:

a cylindrical main body having a first mass; and a cylindrical shaft, extending from said main body and having a second mass, said first and second masses related so that said pin means is held by gravity in said first and second apertures when said shaft is disposed therein and said float means is in said upright position and so that said pin means is automatically pulled by gravity, thereby removing said shaft from said first and second apertures, when said float means is in said overturned position.

* * * * *